US008149187B2

(12) United States Patent
Han et al.

(10) Patent No.: US 8,149,187 B2
(45) Date of Patent: Apr. 3, 2012

(54) ORGANIC LIGHT EMITTING DISPLAY

(75) Inventors: Min Koo Han, Seoul (KR); San Myeon Han, Seoul (KR)

(73) Assignee: Seoul National University Industry Foundation, Seoul (KR)

( * ) Notice: Subject to any disclaimer, the term of this patent is extended or adjusted under 35 U.S.C. 154(b) by 907 days.

(21) Appl. No.: 12/168,204

(22) Filed: Jul. 7, 2008

(65) Prior Publication Data

US 2009/0027312 A1 Jan. 29, 2009

(30) Foreign Application Priority Data

Jul. 23, 2007 (KR) ..... 10-2007-0073427

(51) Int. Cl.
*G09G 3/30* (2006.01)

(52) U.S. Cl. ..... 345/76
(58) Field of Classification Search ..... 345/76–77
See application file for complete search history.

(56) References Cited

U.S. PATENT DOCUMENTS

| | | | | |
|---|---|---|---|---|
| 2005/0140600 | A1* | 6/2005 | Kim et al. | 345/76 |
| 2007/0024542 | A1* | 2/2007 | Chung et al. | 345/76 |
| 2007/0040770 | A1* | 2/2007 | Kim | 345/76 |

FOREIGN PATENT DOCUMENTS

| | | | |
|---|---|---|---|
| JP | 2003216109 | A | 7/2003 |
| JP | 2005004174 | A | 1/2005 |
| JP | 2007121889 | A | 5/2007 |

* cited by examiner

*Primary Examiner* — Amr Awad
*Assistant Examiner* — Waseem Moorad
(74) *Attorney, Agent, or Firm* — IpHorgan Ltd.

(57) ABSTRACT

An organic light emitting display that can minimize degradation of a drive transistor comprising a first switching element whose control electrode is electrically coupled to a scan line, being electrically coupled between a data line and a first voltage line for transmitting a data signal; a drive transistor whose control electrode is electrically coupled to the first switching element, being electrically coupled between the first and second voltage lines; an organic light emitting diode electrically coupled to the drive transistor, displaying an image by a current supplied through the drive transistor; a first capacitive element electrically coupled between the control electrode of the drive transistor and the first switching element; a second capacitive element electrically coupled between the first capacitive element and the second voltage line; a second switching element electrically coupled between the first voltage line and the control electrode of the drive transistor; a third switching element electrically coupled between the first switching element and the drive transistor; a fourth switching element electrically coupled between the control electrode of the drive transistor and the second voltage line; and a fifth switching element electrically coupled between the drive transistor and the second voltage line.

22 Claims, 9 Drawing Sheets

ORGANIC LIGHT EMITTING DISPLAY

CROSS-REFERENCE TO RELATED APPLICATIONS

This application is based on and claims priority to Korean Patent Application No. 10-2007-0073427 filed on Jul. 23, 2007 in the Korean Intellectual Property Office (KIPO), the entire contents of which are hereby incorporated by reference.

BACKGROUND OF THE INVENTION

1. Field of the Invention

The present invention relates to an organic light emitting display, and more particularly, to an organic light emitting display that can minimize degradation of a drive transistor in a pixel circuit of the organic light emitting display and brightness change of an organic light emitting diode caused by the degradation.

2. Description of the Related Art

Generally, a conventional organic light emitting display is a display device emitting light by electrically exciting fluorescent or phosphorescent materials. The organic light emitting display displays images by driving N×M number of organic light emitting cells. The organic light emitting cell includes an anode (ITO), an organic thin film and a cathode (metal) as shown in FIG. 1. The organic thin film has a multi-layered structure including an emitting layer (EML), an electron transport layer (ETL) and a hole transport layer (HTL) for improving lighting efficiency with a balanced combination of an electron and a hole. Further, the organic thin film may include separate an electron injecting layer (EIL) and a hole injection layer (HIL).

A technique for driving the organic light emitting cell includes a passive matrix (PM) technique, and an active matrix (AM) technique using a thin film transistor (TFT) or a metal oxide silicon thin film transistor (MOSFET). The passive matrix technique drives a light emitting cell by forming an anode to be intersected with a cathode and selecting a line. The active matrix technique is a driving technique that connects the transistor and the capacitor to respective indium tin oxide (ITO) pixel electrodes to maintain a voltage by a capacity of a capacitor.

The transistor used in this active matrix technique is an amorphous silicon thin film transistor or polycrystalline silicon thin film transistor. When the amorphous silicon thin film transistor is used as a drive element, current driving power is relatively low. However, uniformity of the display is excellent and the transistor is advantageous in large scale process. However, a threshold voltage of the drive transistor in the pixel circuit for flowing current is gradually increased because the silicon structure is damaged according to current flow caused by a voltage applied to a control electrode thereof. As shown in a transistor current equation of the following equation 1, an amount of current applied to the organic light emitting diode is decreased according to the increase of the threshold voltage. Accordingly, brightness of each pixel is deceased. Thus, there is a problem that brightness of the organic light emitting display is gradually decreased with the lapse of time.

Moreover, there is another problem that the threshold voltage degradation of each pixel circuit is changed according to a data voltage that has been already applied to each pixel circuit, the entire brightness of the organic light emitting display becomes non-uniform.

[Equation 1]

$$I_{OLED} = \frac{\beta}{2}(V_{GS} - V_{TH})^2 \quad (1)$$

In the above equation 1, $I_{OLED}$ is a current flowing in a drive transistor and an organic light emitting diode, $V_{GS}$ is a voltage between gate and source of the drive transistor, $V_{TH}$ is a threshold voltage of the drive transistor, and β is an electric conductivity of the drive transistor.

SUMMARY OF THE INVENTION

Accordingly, an object of the present invention is to provide an organic light emitting display that can minimize threshold voltage change of a drive transistor, in other words, degradation phenomenon and improve an overall brightness uniformity of the display by dividing an image display period of one frame into first and second periods, and applying a positive (or negative) voltage as a data signal to a control electrode of a drive transistor in the first period to allow an organic light emitting diode to emit light, and, in the second period, applying a negative (or positive) voltage opposite to the voltage applied to the control electrode of the drive transistor in the first period to turn off the organic light emitting diode, and simultaneously, negatively annealing the drive transistor.

Another object of the present invention is to provide an organic light emitting display that can prevent motion blur phenomenon and provide a high contrast ratio by controlling a ratio of an emitting drive period to a negative annealing period in an image display period of one frame to 1:1 or other ratio and displaying a first image between one frame and a next frame naturally.

A still another object of the present invention is to provide an organic light emitting display that can compensate a threshold voltage of a drive transistor by connecting the drive transistor in a diode structure and storing the threshold voltage of the drive transistor in a capacitive element electrically coupled to the drive transistor and applying a summed voltage of the threshold voltage and the data voltage to the control electrode of the drive transistor when a data voltage is applied to the drive transistor.

According to one embodiment of the invention, an organic light emitting display is provided. The organic light emitting display includes a first switching element, a drive transistor, an organic light emitting diode, a first capacitive element, a second capacitive element, a second switching element, a third switching element, a fourth switching element, and a fifth switching element. The first switching element having a control electrode is electrically coupled to a scan line, being electrically coupled between a data line and a first voltage line for transmitting a data signal. The drive transistor having a control electrode is electrically coupled to the first switching element, being electrically coupled between the first voltage line and a second voltage line. The organic light emitting diode electrically coupled to the drive transistor, displaying an image by a current supplied through the drive transistor. The first capacitive element electrically coupled between the control electrode of the drive transistor and the first switching element. The second capacitive element electrically coupled between the first capacitive element and the second voltage line. The second switching element electrically coupled between the first voltage line and the control electrode of the drive transistor. The third switching element electrically coupled between the first switching element and the drive transistor. The fourth switching element electrically coupled between the control electrode of the drive transistor and the second voltage line. The fifth switching element electrically coupled between the drive transistor and the second voltage line.

A first electrode of the first switching element may be electrically coupled to the data line, and a second electrode of the first switching element may be electrically coupled between a first electrode of the third switching element and a second electrode of the first capacitive element and a first electrode of the second capacitive element.

A control electrode of the second switching element may be electrically coupled to a previous scan line, and a first electrode of the second switching element may be electrically coupled between a first electrode of the fourth switching element and a first electrode of the first capacitive element and the control electrode of the drive transistor, and a second electrode of the second switching element may be electrically coupled between the first voltage line and the first electrode of the drive transistor.

A control electrode of the third switching element may be electrically coupled to a threshold voltage compensation line, and a first electrode of the third switching element may be electrically coupled between a second electrode of the first switching element and the second electrode of the first capacitive element and the first electrode of the second capacitive element, and a second electrode of the third switching element may be electrically coupled between the drive transistor and the fifth switching element.

A control electrode of the fourth switching element may be electrically coupled to a negative annealing line, and a first electrode of the fourth switching element may be electrically coupled between the control electrode of the drive transistor and the first electrode of the second switching element and the first electrode of the first capacitive element, and a second electrode of the fourth switching element may be electrically coupled to the second voltage line.

A control electrode of the fifth switching element may be electrically coupled to an emission control line, and a first electrode of the fifth switching element may be electrically coupled between the second electrode of the drive transistor and the second electrode of the third switching element, and a second electrode of the fifth switching element may be electrically coupled to the second voltage line.

An anode of the organic light emitting diode may be electrically coupled to the fifth switching element, a cathode of the organic light emitting diode may be electrically coupled to the second voltage.

An anode of the organic light emitting diode may be electrically coupled to the first voltage line, a cathode of the organic light emitting diode may be electrically coupled between the first electrode of the drive transistor and the second electrode of the second switching element.

A first electrode of the first capacitive element may be electrically coupled between the first electrode of the second switching element and the control electrode of the drive transistor and the first electrode of the fourth switching element, and a second electrode of the first capacitive element may be electrically coupled between the second electrode of the first switching element and the first electrode of the third switching element and the first electrode of the second capacitive element.

A first electrode of the second capacitive element may be electrically coupled between the second electrode of the first capacitive element and the second electrode of the first switching element and the first electrode of the third switching element, and a second electrode of the second capacitive element may be electrically coupled between the second electrode of the fourth switching element and the second voltage line.

The first, second, third, fourth and fifth switching elements and the drive transistor are an N type channel transistor.

When the second and fifth switching elements are turned off and the first, third and fourth switching elements are turned on during an image display period of one frame, a data signal may be applied to the second electrode of the drive transistor, and the second voltage may be applied to the control electrode of the drive transistor.

According to another embodiment of the invention, an organic light emitting display is provided. The organic light emitting display includes a first switching element, a drive transistor, an organic light emitting diode, a first capacitive element, a second capacitive element, a second switching element, a third switching element, a fourth switching element, and a fifth switching element. The first switching element having a control electrode is electrically coupled to a scan line, being electrically coupled between a data line and a first voltage line for transmitting a data signal. The drive transistor having a control electrode is electrically coupled to the first switching element, being electrically coupled between the first voltage line and a second voltage line. The organic light emitting diode electrically coupled to the drive transistor, displaying an image by a current supplied through the drive transistor. The first capacitive element electrically coupled between the control electrode of the drive transistor and the first switching element. The second capacitive element electrically coupled between the first capacitive element and the first voltage line. The second switching element electrically coupled between the second voltage line and the control electrode of the drive transistor. The third switching element electrically coupled between the first switching element and the drive transistor. The fourth switching element electrically coupled between the control electrode of the drive transistor and the first voltage line. The fifth switching element electrically coupled between the drive transistor and the first voltage line.

A first electrode of the first switching element may be electrically coupled to the data line, and a second electrode of the first switching element may be electrically coupled between a first electrode of the third switching element and a first electrode of the first capacitive element and a second electrode of the second capacitive element.

A control electrode of the second switching element may be electrically coupled to a previous scan line, and a first electrode of the second switching element may be electrically coupled between a second electrode of the fourth switching element and a second electrode of the first capacitive element and the control electrode of the drive transistor, and a second electrode of the second switching element may be electrically coupled between the second voltage line and the second electrode of the drive transistor.

A control electrode of the third switching element may be electrically coupled to a threshold voltage compensation line, and a first electrode of the third switching element may be electrically coupled between a second electrode of the first switching element and the first electrode of the first capacitive element and the second electrode of the second capacitive element, and a second electrode of the third switching element may be electrically coupled between the drive transistor and the fifth switching element.

A control electrode of the fourth switching element may be electrically coupled to a negative annealing line, and a first electrode of the fourth switching element may be electrically coupled to the first voltage line, and a second electrode of the fourth switching element may be electrically coupled between the control electrode of the drive transistor and the first electrode of the second switching element and the second electrode of the first capacitive element.

A control electrode of the fifth switching element may be electrically coupled to an emission control line, and a first electrode of the fifth switching element may be electrically coupled to the first voltage line, and a second electrode of the fourth switching element may be electrically coupled between the first electrode of the drive transistor and the second electrode of the third switching element.

An anode of the organic light emitting diode may be electrically coupled between the second electrode of the drive transistor and the second electrode of the second switching element, and a cathode of the organic light emitting diode may be electrically coupled to the second voltage.

An anode of the organic light emitting diode may be electrically coupled to the first voltage line, a cathode of the organic light emitting diode may be electrically coupled to the first electrode of the fifth switching element.

A first electrode of the first capacitive element may be electrically coupled between the second electrode of the first switching element and the first electrode of the third switching element and the second electrode of the second capacitive element, and a second electrode of the first capacitive element may be electrically coupled between the first electrode of the second switching element and the control electrode of the drive transistor and the second electrode of the fourth switching element A first electrode of the second capacitive element may be electrically coupled between the first electrode of the fourth switching element and the first voltage line, and a second electrode of the second capacitive element may be electrically coupled between the first electrode of the first capacitive element and the second electrode of the first switching element and the first electrode of the third switching element.

The first, second, third, fourth and fifth switching elements and the drive transistor are a P type channel transistor.

When the second and fifth switching elements are turned off and the first, third and fourth switching elements are turned on during an image display period of one frame, a data signal may be applied to the first electrode of the drive transistor, and the first voltage may be applied to the control electrode of the drive transistor.

BRIEF DESCRIPTION OF THE DRAWING FIGURES

The above and other objects, features and advantages of the present invention will be more apparent from the following detailed description taken in conjunction with the accompanying drawing, in which.

DETAILED DESCRIPTION OF PREFERRED EMBODIMENTS

Figure 1:
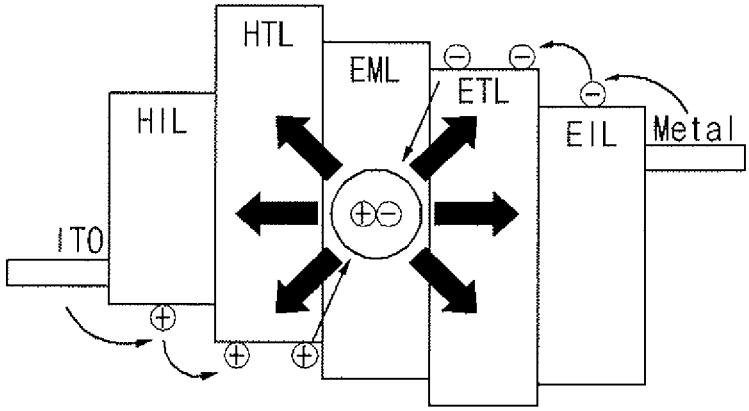
FIG. 1 is a schematic view illustrating a usual organic light emitting diode.

Hereinafter, preferred embodiments of the present invention will be described in detail with reference to the accompanying drawing. The aspects and features of the present invention and methods for achieving the aspects and features will be apparent by referring to the embodiments to be described in detail with reference to the accompanying drawings. However, the present invention is not limited to the embodiments disclosed hereinafter, but can be implemented in diverse forms. The matters defined in the description, such as the detailed construction and elements, are nothing but specific details provided to assist those of ordinary skill in the art in a comprehensive understanding of the invention, and the present invention is only defined within the scope of the appended claims. In the entire description of the present invention, the same drawing reference numerals are used for the same elements across various figures. In addition, a term of "electrically coupled" means not only "directly coupled" but also "coupled via other interposing element".

Figure 2:
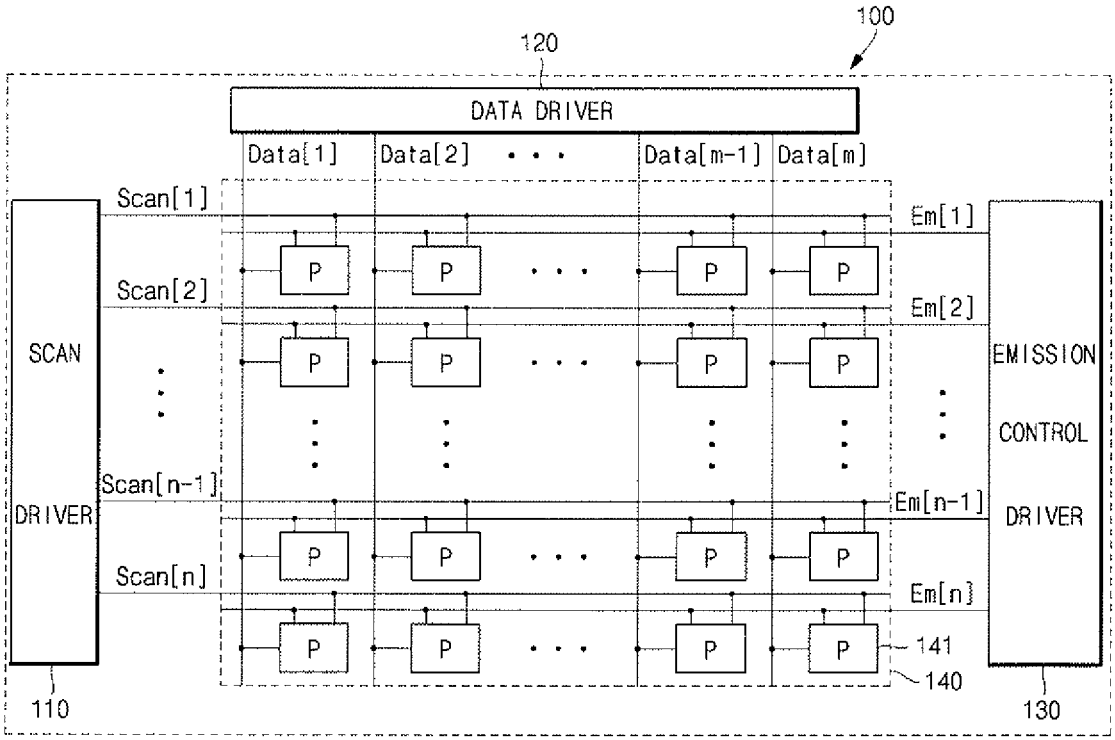
FIG. 2 is a block view illustrating a construction of an organic light emitting display according to the present invention.

FIG. 2 shows a block diagram illustrating an organic light emitting display according to the present invention.

Referring to FIG. 2, the organic light emitting display 100 includes a scan driver 110, a data driver 120, an emission control driver 130, an organic light emitting display panel 140 (hereinafter, referred to as "panel").

The scan driver 110 can sequentially supply scan signals to the panel 140 through a plurality of scan lines Scan[1], Scan [2] to Scan[n]. The data driver 120 can supply data signals to the panel 140 through a plurality of data lines Data[1], Data [2] to Data[m].

The emission control driver 130 can sequentially supply emission control signals to the panel 140 through a plurality of emission control lines Em[1], Em[2] to Em[n]. In addition, the emission control driver 130 can control a pulse width of the emission control signal, and control the number of pulse generated in one period. A pixel circuit 141 connected to the emission control lines Em[1], Em[2] to Em[n] can receive the emission control signal and determine a timing for allowing current generated in the pixel circuit 141 to flow to a light emitting device. Here, circuits of the emission control driver 130, scan driver 110 and data driver 120 may be formed of a transistor the same as that of the pixel circuit. Thus, the circuits may be formed on a substrate without an additional process when the panel is formed. In other words, the circuits may not be formed in a separate chip type.

In addition, the panel 140 may include the plurality of scan lines Scan[1], Scan[2] to Scan[n] and plurality of emission control lines Em[1], Em[2] to Em[n] arranged in a row direction, and the plurality of data lines Data[1], Data[2] to Data [m] arranged in a column direction, and pixel circuits 141 defined by the plurality of scan lines Scan[1], Scan[2] to Scan[n], data lines Data[1], Data[2] to Data[m], and emission control lines Em[1], Em[2] to Em[n].

The pixel circuit may be formed in a pixel region defined by two adjacent scan lines (or emission control lines) and two adjacent data lines. Of course, as described above, the scan signal may be supplied to the scan lines Scan[1], Scan[2] to Scan[n] from the scan driver 110, and the data signal may be supplied to the data lines Data[1], Data [2] to Data [m] from the data driver 120, and the emission control signal may be supplied to the emission control lines Em[1], Em[2] to Em[n].

Figure 3:
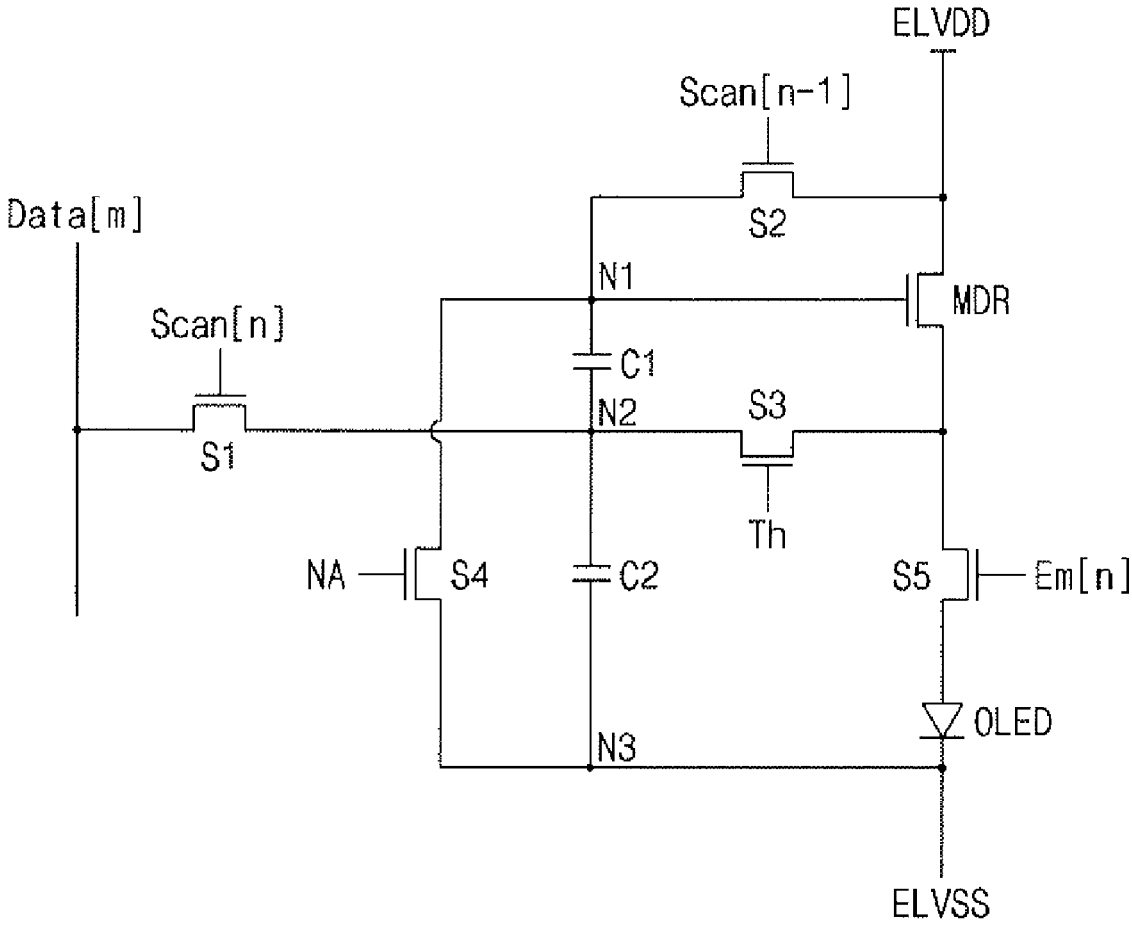
FIG. 3 is a circuit diagram illustrating a pixel circuit of an organic light emitting display according to one exemplary embodiment of the present invention.

FIG. 3 shows a circuit diagram illustrating a pixel circuit of an organic light emitting display according to one exemplary embodiment of the present invention.

Referring to FIG. 3, the pixel circuit of the organic light emitting display includes a scan line Scan[n], a previous scan line Scan[n−1], a data line Data[m], an emission control line Em[n], a threshold voltage compensation line Th, a negative annealing line NA, a first voltage line ELVDD, a second voltage line ELVSS, a drive transistor $M_{DR}$, a first switching element S1, a second switching element S2, a third switching element S3, a fourth switching element S4, a fifth switching element S5, a first capacitive element C1, a second capacitive element C2 and an organic light emitting diode (OLED).

The scan line Scan[n] supplies a scan signal selecting the OLED for emission to a control electrode of the first switching element S1. Of course, the scan line Scan[n] is electrically coupled to the scan driver 110 (see FIG. 2) generating the scan signal.

The previous scan line Scan[n−1] is indicated as Scan[n−1] in a viewpoint that it uses a previously selected 'n−1' the scan line in common. The previous scan line Scan[n−1] is electrically coupled to a control electrode of the second switching element S2 for controlling the second switching element S2. The second switching element S2 connects the drive transistor $M_{DR}$ in a diode structure when a high level previous scan signal is applied to the control electrode thereof.

The data line Data[m] supplies a data signal (voltage) determining a brightness of emission to the first switching element S1. Of course, the data line Data[m] may be electrically coupled to the data driver 120 (See FIG. 2) generating the data voltage.

The emission control line Em[n] is electrically coupled to a control electrode of the fifth switching element S5 and controls an emitting time of the OLED substantially by controlling the fifth switching element S5. Of course, the emission control line Em[n] is electrically coupled to the emission control driver 130 (See FIG. 2) generating the emission control signal.

Figure 4:
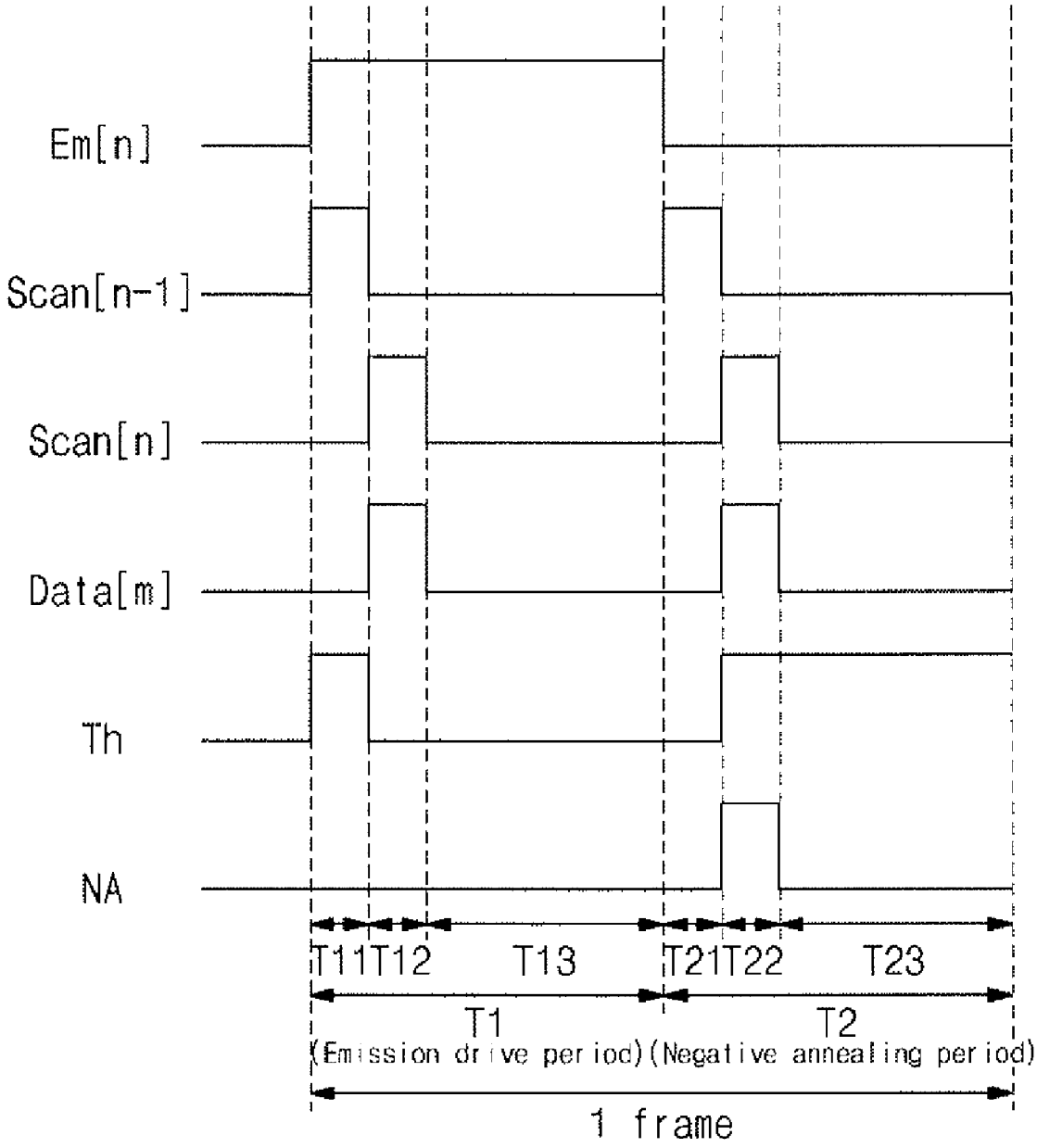
FIG. 4 is a drive timing diagram of the pixel circuit as shown in FIG. 3.

The threshold voltage compensation line Th is electrically coupled to a control electrode of the third switching element S3 and controls the third switching element S3, thereby allowing the first capacitive element C1 to store a threshold voltage of the drive transistor $M_{DR}$ in an emission drive period $T_1$ (see FIG. 4). The threshold voltage compensation line Th controls the third switching element S3 for applying the data voltage to a second electrode of the drive transistor $M_{DR}$ in a negative annealing period $T_2$ (see FIG. 4).

The negative annealing line NA is electrically coupled to a control electrode of the fourth switching element S4 and controls the second voltage to be applied to the control electrode of the drive transistor $M_{DR}$ by controlling the fourth switching element S4.

The first voltage line ELVDD applies a first voltage to the OLED.

The second voltage line ELVSS applies a second voltage to the OLED. Here, the first voltage is high level than the second voltage.

A first electrode of the drive transistor $M_{DR}$ is electrically coupled to the first voltage line ELVDD, and a second electrode thereof is electrically coupled between the first electrode of the fifth switching element S5 and the second electrode of the third switching element S3, and a control electrode thereof is electrically coupled to the first electrode of the first capacitive element C1. Here, the second electrode of the first capacitive element C1 is electrically coupled to the data line Data[m] to apply the data signal the control electrode of the drive transistor $M_{DR}$. The drive transistor $M_{DR}$ is an N type transistor. When a data signal of a high level (or positive voltage) is applied through the control electrode, the drive transistor $M_{DR}$ is turned on to supply a predetermined amount of voltage from the first voltage line ELVDD to the OLED. On the other hand, even if a low level scan signal is applied to the control electrode of the first switching element S1 and the drive transistor $M_{DR}$ is turned off, the data signal of a high level (or positive voltage) is continuously applied to the control electrode of the drive transistor $M_{DR}$ for a predetermined time by charged voltage of the second capacitive element C2 because the second electrode of the first capacitive element C1 and the first electrode of the second capacitive element C2 are charged by the data signal of the high level supplied to N2 between them.

Here, the drive transistor $M_{DR}$ may be any one selected from an amorphous silicon thin film transistor, a poly-silicon thin film transistor, an organic thin film transistor, a nano thin film transistor, an oxide thin film transistor and its equivalents, but not limited thereto.

In addition, when the drive transistor $M_{DR}$ is a poly-silicon thin film transistor, the drive transistor $M_{DR}$ can be formed by any one method selected from a laser crystallization, a metal induced crystallization, a high pressure crystallization, a high temperature crystallization, a direct deposition and its equivalents, but not limited thereto.

The laser crystallization method crystallizes amorphous silicon by irradiating, for example, excimer laser to the amorphous silicon. The metal induced crystallization method starts crystallization from metal by placing, for example, metal on the amorphous silicon and heating at a predetermined temperature. The high pressure crystallization method crystallizes the amorphous silicon by applying, for example, a predetermined pressure to the amorphous silicon.

In addition, when the drive transistor $M_{DR}$ is manufactured by the metal induced crystallization, the drive transistor $M_{DR}$ may further include any one selected from nickel (Ni), cadmium (Cd), cobalt (Co), titanium (Ti), palladium (Pd), tungsten (W) and its equivalents.

The first electrode (drain or source electrode) of the first switching element S1 is electrically coupled to the data line Data[m], and the second electrode (source or drain electrode) thereof is electrically coupled to N2 between the second electrode of the first capacitive element C1 and the first electrode of the second capacitive element C2 and a control electrode thereof is electrically coupled to a scan line Scan[n]. When a high level scan signal is applied to the control electrode of the first switching element S1, the first switching element S1 is turned on to supply the data signal applied from the data line Data[m] to N2 between the second electrode of the first capacitive element C1 and the first electrode of the second capacitive element C2.

The first electrode of the second switching element S2 is electrically coupled between a first electrode N1 of the first capacitive element C1 and the control electrode of the drive transistor $M_{DR}$, and the second electrode thereof is electrically coupled between the first electrode of the drive transistor $M_{DR}$ and the first voltage line ELVDD, and the control electrode thereof is electrically coupled to the previous scan line Scan[n−1]. When a high level previous scan signal is applied to the control electrode of the second switching element S2, the second switching element S2 is turned on to connect the drive transistor $M_{DR}$ in the diode structure.

The first electrode of the third switching element S3 is electrically coupled between the second electrode of the first switching element S1 and a second electrode of the first capacitive element C1 and a first electrode of the second capacitive element C2, and the second electrode thereof is electrically coupled between the second electrode of the drive transistor $M_{DR}$ and a first electrode of the fifth switching element S5, and the control electrode thereof is electrically coupled to the threshold voltage compensation line Th. When a high level threshold voltage compensation signal is applied to the control electrode of the third switching element S3, the third switching element S3 is turned on. Then, the third switching element S3 stores a voltage corresponding to the threshold voltage of the drive transistor $M_{DR}$ in the first capacitive element C1 from the first voltage in the emission drive period, or applies the data signal to the second electrode of the drive transistor MDR in the negative annealing period.

The first electrode of the fourth switching element S4 is electrically coupled between the control electrode of the drive transistor MDR and the first electrode N1 of the first capacitive element C1, and the second electrode thereof is electrically coupled between the second electrode of the second capacitive element C2 and the second voltage line ELVSS, and the control electrode thereof is electrically coupled to the negative annealing line NA. When a negative annealing signal is applied to the control electrode of the fourth switching element S4, the fourth switching element S4 is turned on to apply the second voltage to the control electrode.

The first electrode of the fifth switching element 85 is electrically coupled to the second electrode of the drive transistor MDR, and the second electrode thereof is electrically coupled to the OLED, and the control electrode thereof is electrically coupled to the emission control line Em[n]. When a high level emission control signal is applied to the control electrode of the fifth switching element S5, the fifth switching element S5 is turned on to apply a drive current of the drive transistor MDR to the OLED.

The first electrode of the first capacitive element C1 is electrically coupled between the control electrode of the drive transistor MDR and the second switching element S2, and a second electrode thereof electrically coupled between the first switching element S1, third switching element S3 and the second capacitive element C2. The first capacitive element C1 stores a voltage corresponding to a voltage difference between the first and second electrodes of the first capacitive element C 1.

The first electrode of the second capacitive element C2 is electrically coupled between the first capacitive element C1 and first and third switching element S3*s*, and a second electrode thereof electrically coupled between the second electrode of the fourth switching element S4 and the second voltage line ELVSS. The second capacitive element C2 stores a voltage corresponding to a voltage difference between the first and second electrodes of the second capacitive element C2.

An anode of the OLED may be electrically coupled to the second electrode of the fifth switching element S5, and a cathode thereof may be electrically coupled to the second voltage line ELVSS. The OLED emits light of a predetermined brightness by current controlled through the drive transistor MDR.

The OLED includes an emitting layer (EML, see FIG. 1). The emitting layer may be any one selected from fluorescent material, phosphorescent material and its equivalents, but not limited thereto. In addition, the emitting layer (EML) may be any one selected from red, green, blue emitting materials and its equivalents, but not limited thereto.

FIG. 4 shows a drive timing diagram of the pixel circuit as shown in FIG. 3. Referring to FIG. 4, one frame of the drive timing of the pixel circuit can be divided into first and second periods. More particularly, one frame is constituted of an emission drive period $T_1$ and a negative annealing period $T_2$. Desirably, a ratio of the emission drive period $T_1$ to a negative annealing period $T_2$ may be 1:1, but not limited thereto.

The emission drive period $T_1$ is a period in which actually the OLED emits light of a predetermined brightness and simultaneously a predetermined data signal is applied to the control electrode of the drive transistor MDR. The negative annealing period $T_2$ is a period in which a signal having polarity opposite to the data signal applied to the control electrode of the drive transistor MDR in the emission drive period $T_1$ is applied for annealing under the condition that the OLED is turned off. Here, the negative annealing period $T_2$ is called as negative annealing because the signal having polarity opposite to the data signal applied in the emission drive period $T_1$ is applied for annealing. The emission drive period $T_1$ is constituted of a threshold voltage compensation period $T_{11}$, a data recording period $T_{12}$ and an emitting period $T_{13}$. The negative annealing period $T_2$ is constituted of a delay period $T_{21}$, an annealing signal recording period $T_{22}$ and an annealing period $T_{23}$.

Figure 5:
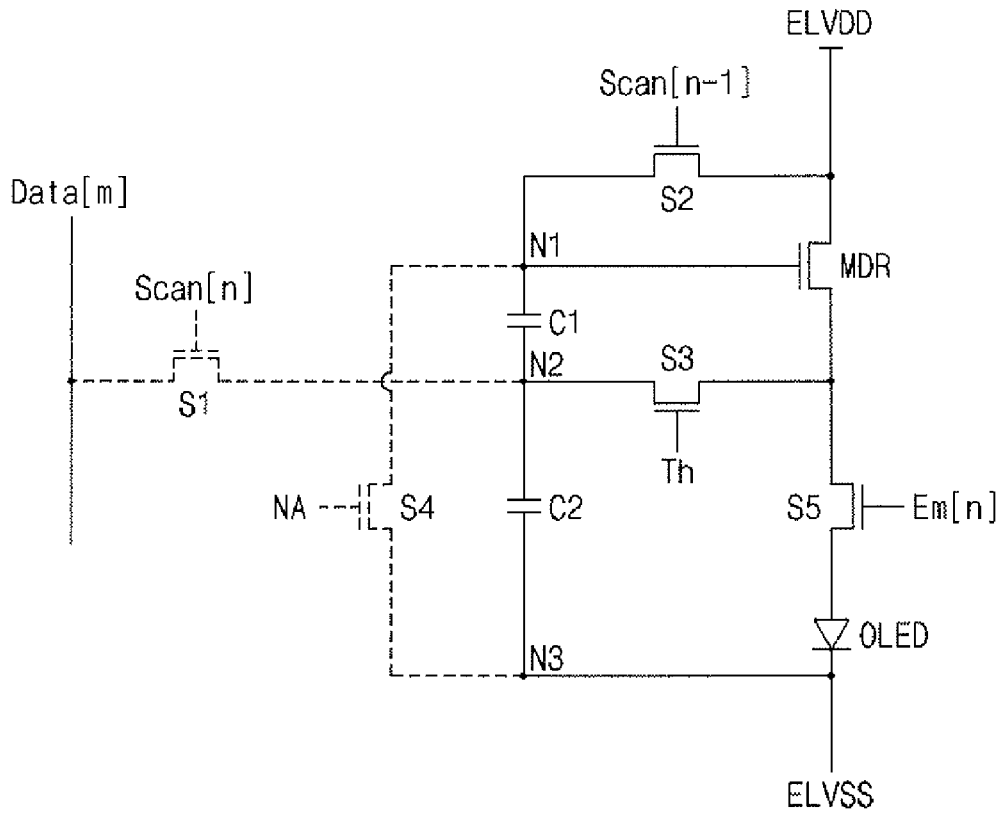
FIG. 5 is a circuit diagram illustrating an operation of the pixel circuit during a threshold voltage compensation period $T_{11}$ of an emitting drive period $T_1$ of the pixel circuit as shown in FIG. 4.

FIG. 5 shows a circuit diagram illustrating an operation of the pixel circuit during a threshold voltage compensation period ($T_{11}$) of an emitting drive period ($T_1$) of the pixel circuit as shown in FIG. 4. Operation of the pixel circuit will be explained with reference to the timing diagram of FIG. 4.

In the threshold voltage compensation period $T_{11}$, a high level previous scan signal is applied to the previous scan line Scan[n−1] to turn on the second switching element S2, and a high level threshold voltage compensation signal is applied to the threshold voltage compensation line Th to turn on the third switching element S3, and a high level emission control signal is applied to the emission control line Em[n] to turn on the fifth switching element S5. A low level signal is applied to the scan line Scan[n] and negative annealing line NA to turn off the first and fourth switching elements S1 and S4.

The second switching element S2 is turned on to connect the drive transistor MDR in the diode structure. The third switching element S3 is turned on to apply a voltage difference between the first voltage and the threshold voltage of the drive transistor MDR to N2 between the first and second capacitive elements C1 and C2.

The first electrode N1 of the first capacitive element C1 is electrically coupled to the first voltage line ELVDD, and the second electrode thereof is electrically coupled to the second electrode of the drive transistor MDR because the third switching element S3 is turned on. In this time, the drive transistor MDR is connected in the diode structure. Accordingly, a voltage corresponding to the difference between the first voltage line ELVDD and the second electrode of the drive transistor MDR is applied to the first capacitive element C1. In this time, the voltage difference between the first and second electrodes N1 and N2 of the first capacitive element C1 is the same as the threshold voltage of the drive transistor MDR. Accordingly, the first capacitive element C1 stores the threshold voltage of the drive transistor MDR.

Figure 6:
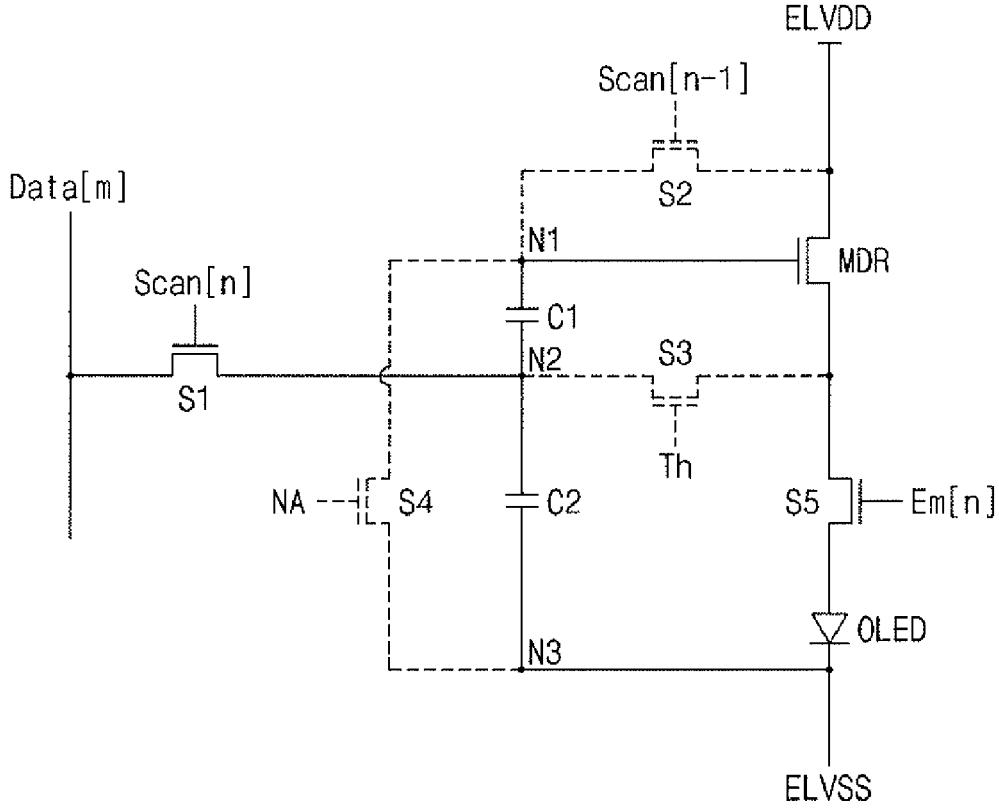
FIG. 6 is a circuit diagram illustrating an operation of the pixel circuit during a data recording period $T_{12}$ of the emitting drive period $T_1$ of the pixel circuit as shown in FIG. 4.

FIG. 6 shows a circuit diagram illustrating an operation of the pixel circuit during a data recording period $T_{12}$ of the emitting drive period $T_1$ of the pixel circuit as shown in FIG. 4. Operation of the pixel circuit will be explained with reference to the timing diagram of FIG. 4.

In the data recording period $T_{12}$, a high level scan signal is applied to the scan line Scan[n] to turn on the first switching element S1, and a high level emission control signal is applied to the emission control line Em[n] to turn on the fifth switching element S5. A low level signal is applied to the previous scan line Scan[n−1], threshold voltage compensation line Th and negative annealing line NA to turn off the first, third and fourth switching elements S1, S3 and S4.

When the first switching element S1 is turned on to apply a data signal of a high level (positive voltage) applied from the data line Data[m] to N2 between the second electrode of the first capacitive element C1 and the first electrode of the second capacitive element C2, the first capacitive element C1 applies a voltage corresponding to a sum of the threshold voltage of the drive transistor MDR stored in the first capacitive element C1 in the threshold voltage compensation period $T_{11}$ and the data signal (positive voltage) applied to the second electrode of the first capacitive element C1, to the control electrode of the drive transistor MDR, and the fifth switching element S5 is turned on to apply a voltage applied from the drive transistor MDR to the OLED. The data signal is applied to the first electrode N2 of the second capacitive element C2, and a second electrode thereof is electrically coupled to the second voltage line ELVSS. Thus, the second capacitive element C2 stores the data signal.

The current transmitted to the OLED in the data recording period $T_{12}$ is represented by the following equation 2:

[Equation 2]

$$\begin{aligned} I_{OLED} &= \frac{\beta}{2}(V_{GS} - V_{TH})^2 \\ &= \frac{\beta}{2}(V_G - V_S - V_{TH})^2 \\ &= \frac{\beta}{2}(V_{DATA} + V_{TH} - V_S - V_{TH})^2 \\ &= \frac{\beta}{2}(V_{DATA} - V_S)^2 \end{aligned} \quad 2$$

Where $V_{GS}$ is a voltage between gate and source of a drive transistor $M_{DR}$, VG is a gate voltage of the drive transistor MDR, and VS is a source voltage of the drive transistor $M_{DR}$, and VDATA is a data signal (positive voltage) applied from a data line Data[m], and VTH is a threshold voltage of the drive transistor $M_{DR}$, and β is a constant, and $I_{OLED}$ is a drive current flowing in an OELD As shown in the equation 1, the threshold voltage is cancelled by a gate voltage of the drive transistor $M_{DR}$ stored in the first capacitive element C1 during the threshold voltage compensation period $T_{11}$ and thus disappears from the drive current. Accordingly, the OLED of each pixel circuit 141 (See FIG. 2) emits light of the same brightness irrelevant to a difference between threshold voltages of each drive transistor $M_{DR}$, thereby realizing the organic light emitting display of a high grayscale. In addition, it is possible to prevent brightness of the organic light emitting display from being changed by the threshold voltage degradation of the drive transistor $M_{DR}$ with the lapse of time.

Figure 7:
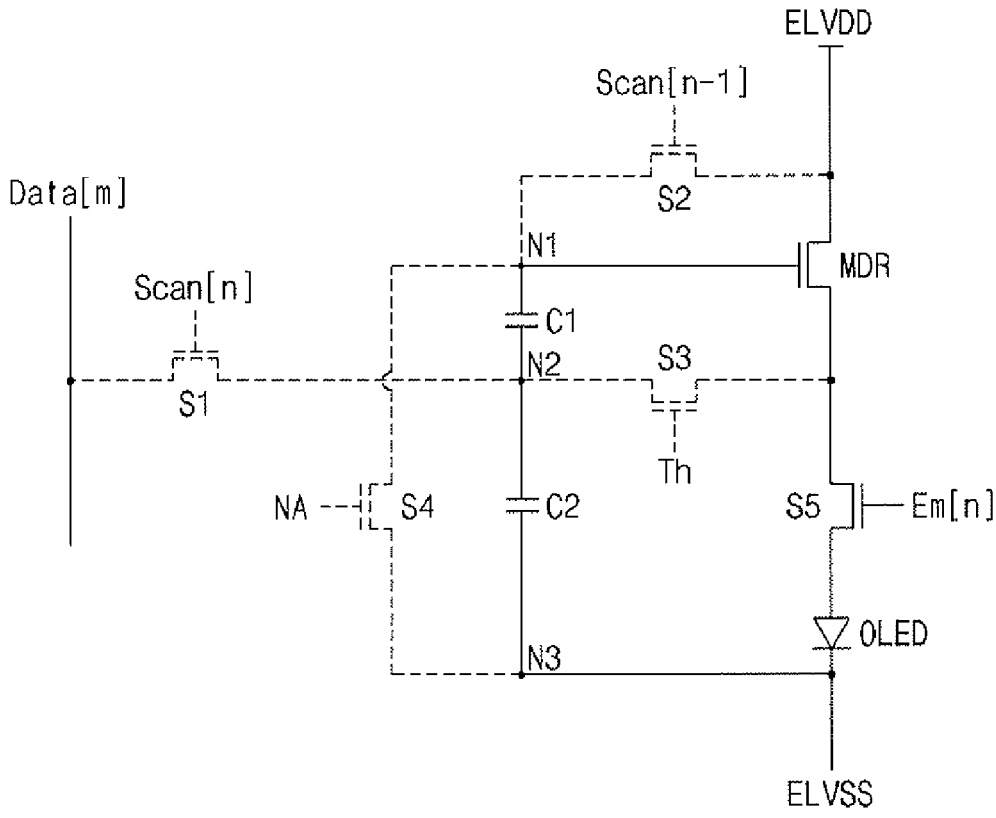
FIG. 7 is a circuit diagram illustrating an operation of the pixel circuit during a emitting period $T_{13}$ of the emitting drive period $T_1$ of the pixel circuit as shown in FIG. 4.

FIG. 7 shows a circuit diagram illustrating an operation of the pixel circuit during an emitting period $T_{13}$ of the emitting drive period $T_1$ of the pixel circuit as shown in FIG. 4. Operation of the pixel circuit will be explained with reference to the timing diagram of FIG. 4.

In the emitting period $T_{13}$, a high level scan signal is applied to the emission control line Em[n] to turn on the fifth switching element S5. A low level signal is applied to the scan line Scan[n], previous scan line Scan[n−1], threshold voltage compensation line Th and negative annealing line NA to turn off the first, second, third and fourth switching elements S1, S2, S3 and S4.

The drive transistor $M_{DR}$ is operated the same as the operation the data recording period $T_{12}$ by the data signal stored in the second capacitive element C2 during the data recording period $T_{12}$ until the fifth switching element S5 is turned off even if the first switching element S1 is turned off to interrupt the data signal applied to N2 between the second electrode of the first capacitive element C1 and the first electrode of the second capacitive element C2. Thus, the same current as that in the data recording period $T_{12}$ flows to the OLED, thereby allowing the OLED to emit light.

Figure 8:
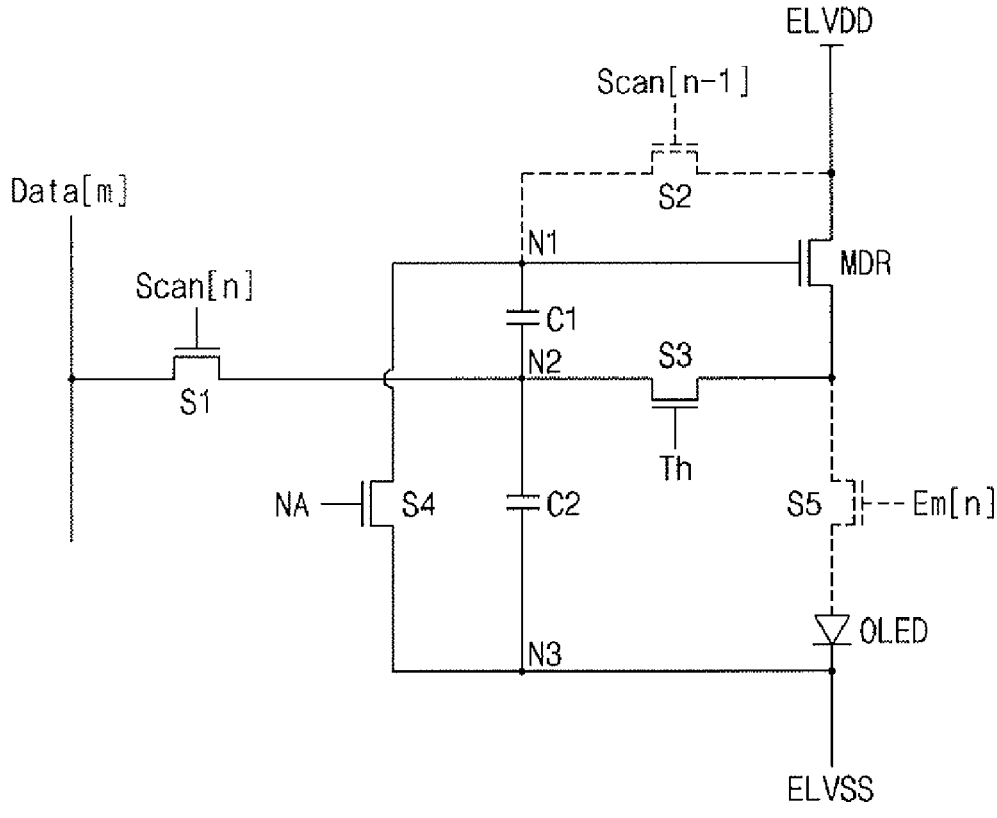
FIG. 8 is a circuit diagram illustrating an operation of the pixel circuit during a negative annealing period $T_2$ of the pixel circuit as shown in FIG. 4.

FIG. 8 shows a circuit diagram illustrating an operation of the pixel circuit during a negative annealing period $T_2$ of the pixel circuit as shown in FIG. 4. Operation of the pixel circuit will be explained with reference to the timing diagram of FIG. 4.

The negative annealing period $T_2$ is constituted of a delay period $T_{21}$, an annealing signal recording period $T_{22}$ and an annealing period $T_{23}$. The circuit diagram illustrating the operation of the pixel circuit of FIG. 4 is related to the annealing signal recording period $T_{22}$.

The delay period $T_{21}$ is a period in which a high level scan signal is applied to the previous scan line Scan[n−1] before the annealing signal recording period $T_{22}$ and annealing period $T_{23}$. The second switching element S2 is operated by using the previous scan line Scan[n−1] in the emission drive period $T_1$, and the previous scan signal of the previous scan line Scan[n−1] is a signal that is identically applied in a high level before the scan signal of the scan line Scan[n] is applied in a high level. The previous scan signal is used in the emission drive period $T_1$, but not used in the negative annealing period $T_2$. Thus, the pixel circuit is not operated in the delay period $T_{21}$.

Operation of the pixel circuit during the annealing signal recording period $T_{22}$ is shown in FIG. 8. In the annealing signal recording period $T_{22}$, a high level scan signal is applied to the scan line Scan[n] to turn on the first switching element S1, and a high level threshold voltage compensation signal is applied to the threshold voltage compensation line Th to turn on the third switching element S3. A high level signal is applied to the negative annealing line NA to turn on the fourth switching element S4. A low level signal is applied to the previous scan line Scan[n−1] and emission control line Em[n] to turn off the second and fifth switching elements S2 and S5.

The first switching element S1 is turned on to apply a data signal of a high level (positive voltage) applied from the data line Data[m] to N2 between the second electrode of the first capacitive element C1 and the first electrode of the second capacitive element C2. The third switching element S3 is turned on to apply a data signal to the second electrode of the drive transistor $M_{DR}$. The fourth switching element S4 is turned on to apply the second voltage ELVSS to the second electrode of the drive transistor $M_{DR}$. In other words, a data signal of a low level (negative voltage) opposite to the data signal of the high level (positive voltage) applied to the drive transistor $M_{DR}$ in the data recording period $T_{12}$ is applied as the voltage between the control electrode and second electrode of the drive transistor $M_{DR}$. The drive transistor $M_{DR}$ is applied with the data signal of the low level (negative voltage) opposite to that of the emission drive period $T_1$ and negatively annealed.

The fourth switching element S4 is turned on to apply the second voltage ELVSS to the first electrode N1 of the first capacitive element C1, and apply a data signal of a high level (positive voltage) to the second electrode N2 thereof. In this time, a voltage corresponding to a voltage difference between the first and second electrodes of the first capacitive element C1 is stored in the first capacitive element C1.

The data signal of the high level (positive voltage) is applied to the first electrode N2 of the second capacitive element C2, and the second voltage ELVSS is applied to the second electrode N3 thereof, Thus, a voltage corresponding to a voltage difference between the first and second electrodes of the second capacitive element C2 is stored in the second capacitive element C2.

In the annealing period $T_{23}$, a high level threshold voltage compensation signal is applied to the threshold voltage compensation line Th to turn on the third switching element S3. A low level signal is applied to the emission control line Em[n], scan line Scan[n], previous scan line Scan[n−1], and negative annealing line NA to turn off the first, second, fourth and fifth switching elements S1, S2, S4 and S5.

The first switching element S1 is turned off to interrupt the data signal applied to the N2 between the second electrode of the first capacitive element C1 and the first electrode of the second capacitive element C2. The fourth switching element S4 is turned off to interrupt the second voltage applied to the control electrode of the drive transistor $M_{DR}$. The data signal stored in the first and second capacitive elements C1 and C2 in the annealing signal recording period $T_{22}$ is applied to the drive transistor $M_{DR}$ until the third switching element S3 is turned off. Thus, the drive transistor $M_{DR}$ is continuously annealed until one frame is terminated under the condition that it is completely turned off.

As described above, in the emission drive period $T_1$ and negative annealing period $T_2$, the data signal of positive voltage and data signal of negative voltage are sequentially applied between the control electrode and second electrode of the drive transistor $M_{DR}$. In other words, the data signal of negative voltage used in emitting is supplied to the control electrode of the drive transistor $M_{DR}$. Accordingly, if the previous data signal is low, a low negative voltage is applied to the control electrode of the drive transistor $M_{DR}$. On the contrary, if the previous data signal is high in the previous emitting, a high negative voltage is applied to the control electrode of the drive transistor $M_{DR}$. Thus, the non-uniform brightness phenomenon of the entire panel can be prevented by negatively annealing in proportional to the data signal supplied to each pixel circuit.

As described above, the ratio of the emission drive period $T_1$ to the negative annealing period $T_2$ in one frame can be variously controlled to 1:1 or other ratio. For example, when the ratio of the emission drive period $T_1$ to the negative annealing period $T_2$ is 1:1, the data signal is applied in a speed of 120 frames per second for realizing a screen of 60 frames per second, and the same data voltage is applied to each pixel once in the emitting period, and once more in the negative annealing period. Accordingly, there is the negative annealing period between the emission drive period of the pixel and next emission drive period. In the negative annealing period, emission is not performed. Accordingly, a first image (for example, a black image) is naturally displayed between frames. Thus, motion blur phenomenon is naturally prevented, and a high contrast ration can be obtained.

Figure 9:
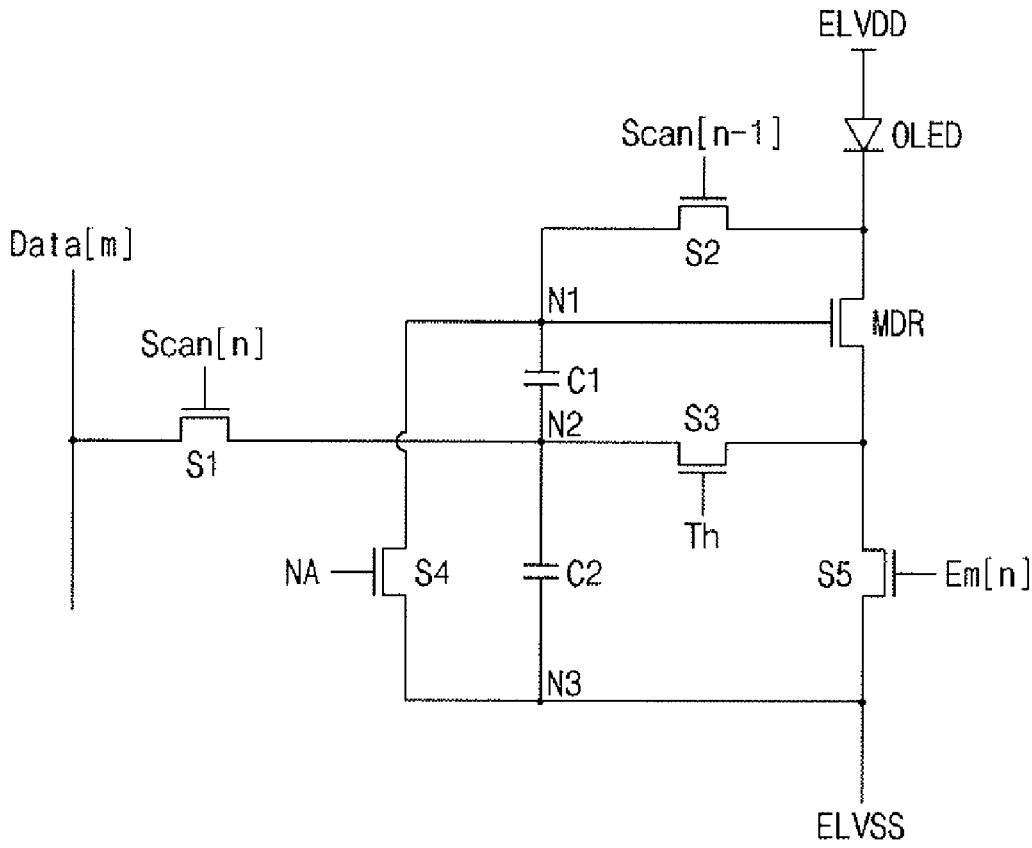
FIG. 9 is a circuit diagram illustrating a pixel circuit of an organic light emitting display according to another exemplary embodiment of the present invention.

FIG. 9 shows a circuit diagram illustrating a pixel circuit of an organic light emitting display according to another exemplary embodiment of the present invention.

Referring to FIG. 9, the pixel circuit of the organic light emitting display is similar to that shown in FIG. 3 except that an OLED is electrically coupled between a first voltage line ELVDD and a first electrode of a drive transistor $M_{DR}$. The OLED may be provided between a fifth switching element S5 and a second voltage line ELVSS as shown in FIG. 3, or may be provided between the first voltage line ELVDD and the drive transistor $M_{DR}$ as shown in FIG. 9 in consideration of circuit design. Operation of the pixel circuit of FIG. 9 is the same as that the pixel circuit as described above in FIGS. 4 to 8.

Figure 10:
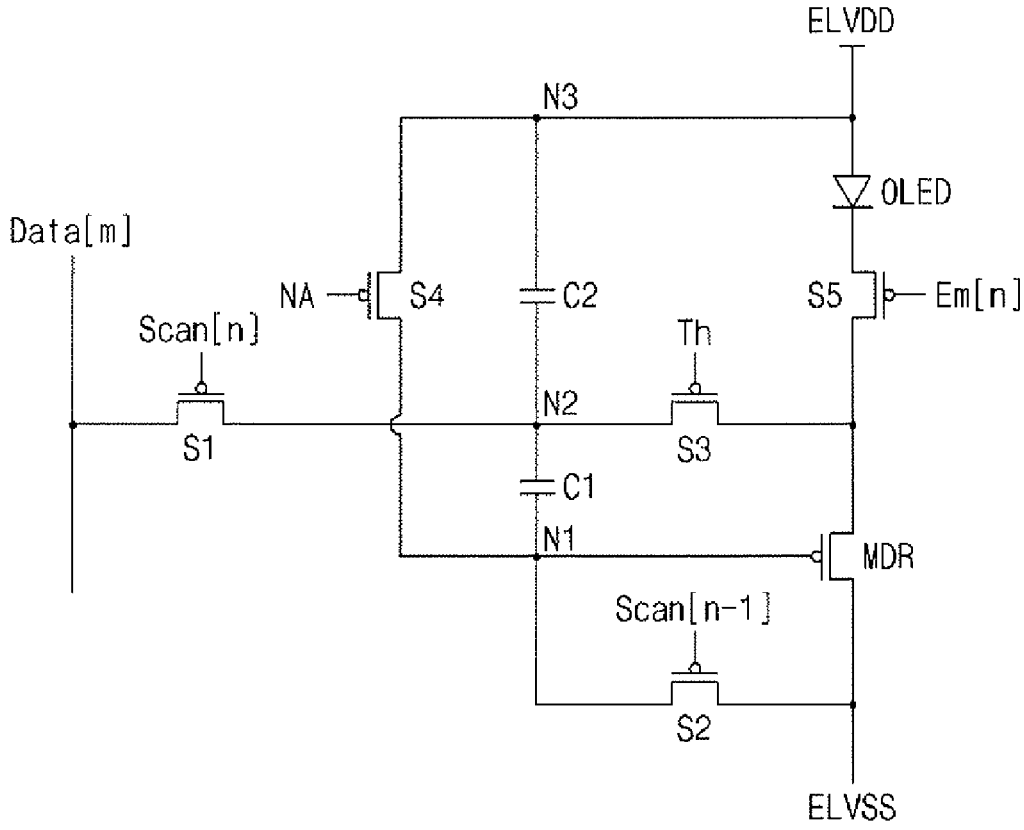
FIG. 10 is a circuit diagram illustrating a pixel circuit of an organic light emitting display according to a still another exemplary embodiment of the present invention.

FIG. 10 shows a circuit diagram illustrating a pixel circuit of an organic light emitting display according to a still another exemplary embodiment of the present invention.

Referring to FIG. 10, the pixel circuit of an organic light emitting display is similar to that shown in FIG. 3 except that a drive transistor $M_{DR}$ and all switching elements are a P type channel transistor differently from the pixel circuit of FIG. 3 whose drive transistor $M_{DR}$ and all switching elements are the N type channel transistor. Accordingly, electrical coupling relationship between each element is somewhat different.

For example, a first electrode of the drive transistor $M_{DR}$ is electrically coupled to a second electrode of a fifth switching element S5, a second electrode thereof is electrically coupled to a second voltage line ELVSS. In addition, an anode of an OLED may be electrically coupled to a first voltage line ELVDD, and a cathode thereof may be electrically coupled to a first electrode of the fifth switching element S5. In addition, a first electrode of a second switching element S2 is electrically coupled to a control electrode of the drive transistor $M_{DR}$, and a second electrode thereof is electrically coupled to the second voltage line ELVSS, In addition, a first electrode of a fourth switching element S4 is electrically coupled to the first voltage line ELVDD, and a second electrode thereof is electrically coupled to the second voltage line ELVSS. In addition, a first electrode of a second capacitive element C2 is electrically coupled to the first voltage line ELVDD, and a second electrode thereof is electrically coupled between the first and third switching elements S1 and S3. Other constructions are the same as the pixel circuit shown in FIG. 3.

Figure 11:
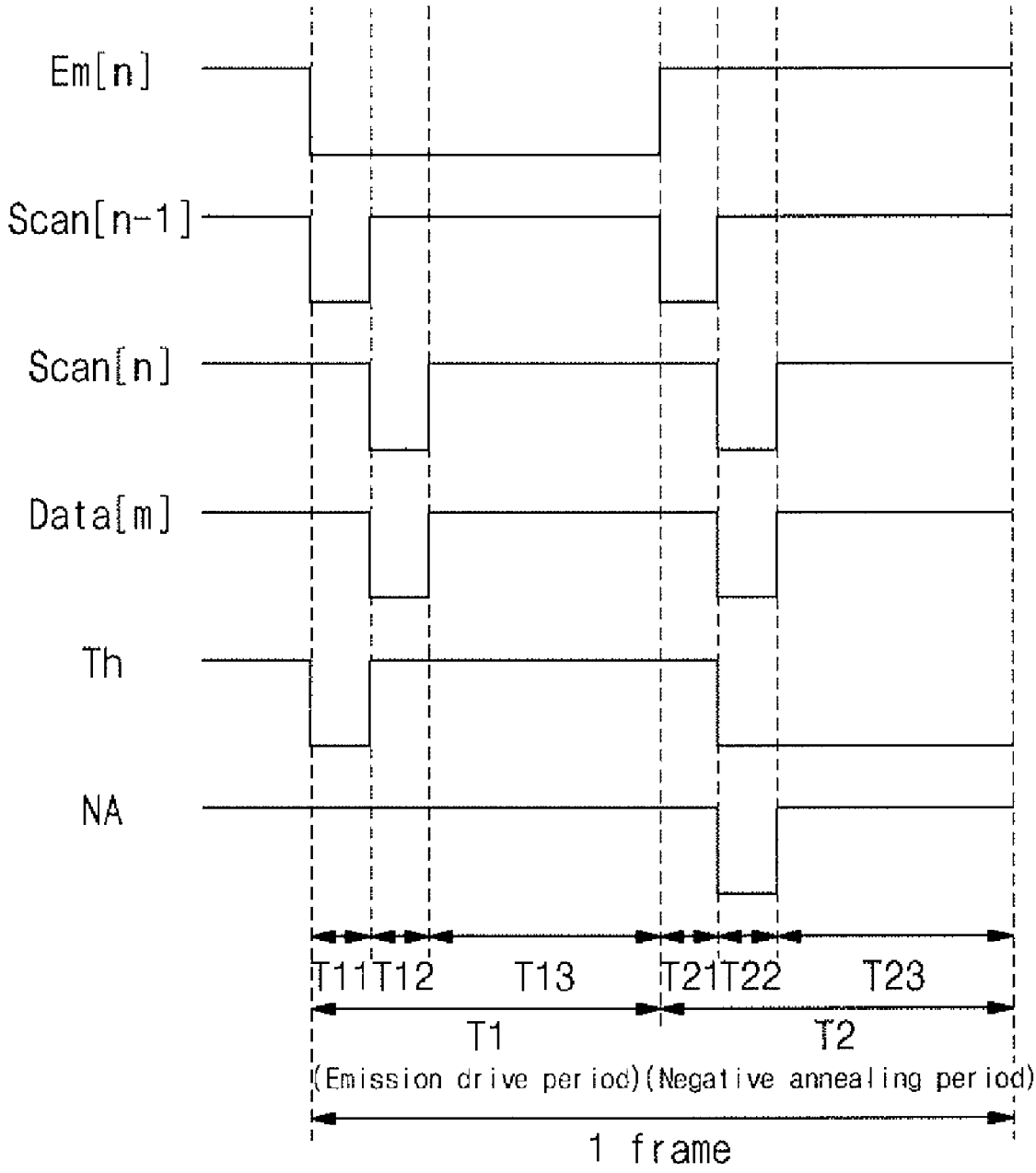
FIG. 11 is a drive timing diagram of the pixel circuit as shown in FIG. 10.

FIG. 11 shows a drive timing diagram of the pixel circuit as shown in FIG. 10.

As shown in FIG. 11, the operation of the pixel circuit shown in FIG. 10 is similar to those of the pixel circuit and drive timing operation shown in FIGS. 3 and 4. Merely, the drive transistor $M_{DR}$ and switch devices are turned on when a low level signal is applied to the control electrodes of them because they are the P type channel transistor. In addition, the data signal applied from a data line Data[m] is also low level.

One frame of the pixel circuit shown in FIG. 10 is constituted of an emission drive period and a negative annealing period. In other words, in the emission drive period $T_1$, a data signal of a low level (or negative voltage) is applied to the control electrode of the drive transistor $M_{DR}$. In the negative annealing period $T_2$, the first voltage is applied to the control electrode of the drive transistor $M_{DR}$, and the data signal of a high level (or positive voltage) is applied to the first electrode thereof. In other words, the negative and positive voltages are alternatively and sequentially applied between the control electrode and first electrode of the drive transistor $M_{DR}$ in the emission drive period $T_1$ and negative annealing period $T_2$.

Figure 12:
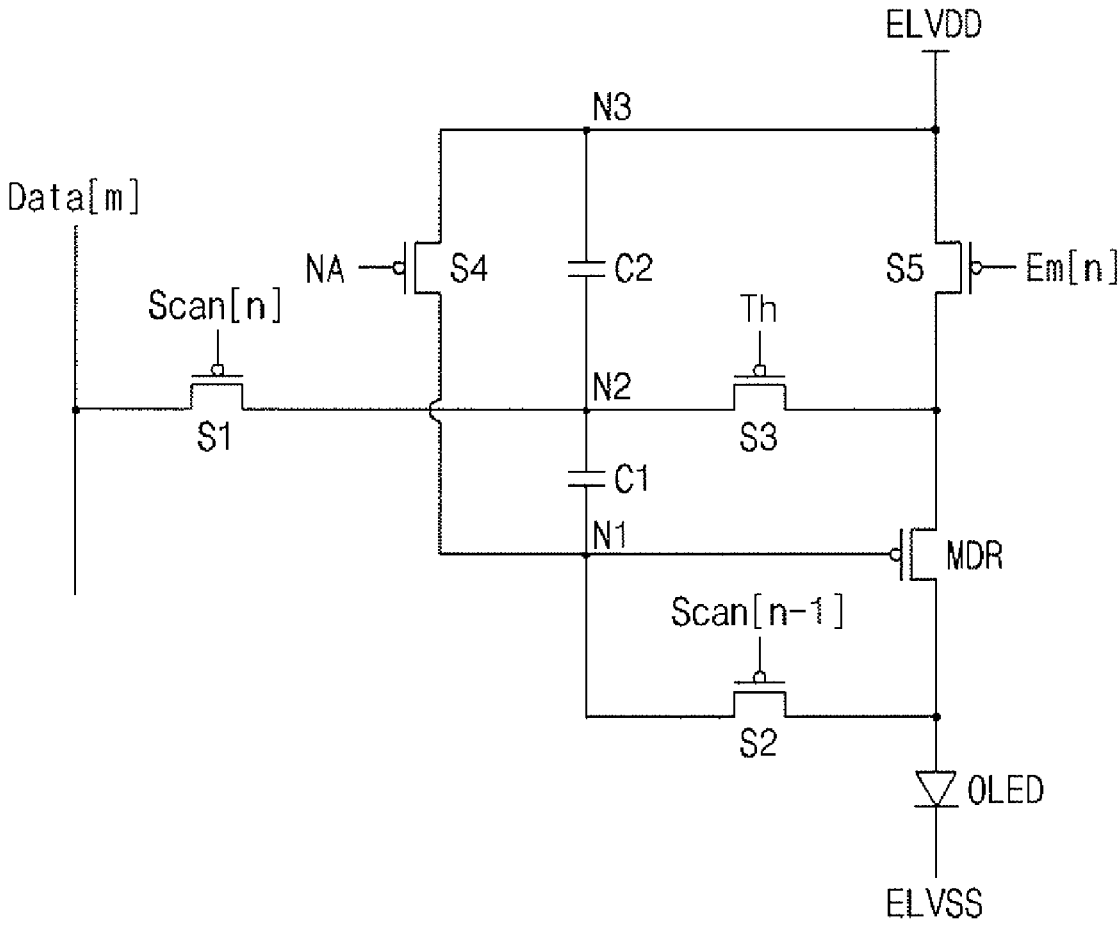
FIG. 12 is a circuit diagram illustrating a pixel circuit of an organic light emitting display according to a further still another exemplary embodiment of the present invention.

FIG. 12 shows a circuit diagram illustrating a pixel circuit of an organic light emitting display according to a further still another exemplary embodiment of the present invention. Referring to FIG. 12, the pixel circuit of the organic light emitting display is similar to that shown in FIG. 10 except that an OLED is electrically coupled between a second electrode of a drive transistor $M_{DR}$ and a second voltage line ELVSS. The OLED may be provided between a first voltage line ELVDD and a fifth switching element S5 as shown in FIG. 10, or may be provided between the drive transistor $M_{DR}$ and the second voltage line ELVSS as shown in FIG. 12 in consideration of circuit design. Operation of the pixel circuit of FIG. 12 is the same as that the pixel circuit of FIG. 10 as described above in FIG. 11.

As described above, the organic light emitting display according to the present invention produces the following effects.

First, the organic light emitting display can minimize the threshold voltage change of the drive transistor, in other words, degradation phenomenon and improve the overall brightness uniformity of the display by dividing the image display period of one frame into first and second periods, and applying a positive (or negative) voltage as the data signal to the control electrode of the drive transistor in the first period to allow the organic light emitting diode to emit light, and, in the second period, applying a negative (or positive) voltage opposite to the voltage applied to the control electrode of the drive transistor in the first period to turn off the organic light emitting diode, and simultaneously, negatively annealing the drive transistor.

Second, the organic light emitting display can prevent the motion blur phenomenon and realize a high contrast ratio by controlling the ratio of the emitting drive period to a negative annealing period in the image display period of one frame to 1:1 or other ratio and displaying the first image between one frame and a next frame naturally.

Third, the organic light emitting display can compensate the change and difference of the threshold voltage of the drive transistor by connecting the drive transistor in the diode structure and storing the threshold voltage of the drive transistor in the capacitive element electrically coupled to the drive transistor and applying the summed voltage of the threshold voltage and the data voltage to the control electrode of the drive transistor when the data voltage is applied to the drive transistor.

It should be understood by those of ordinary skill in the art that various replacements, modifications and changes in the form and details may be made therein without departing from the spirit and scope of the present invention as defined by the following claims. Therefore, it is to be appreciated that the above described embodiments are for purposes of illustration only and are not to be construed as limitations of the invention.

What is claimed is:

1. An organic light emitting display, comprising:

a first switching element having a control electrode is electrically coupled to a scan line, being electrically coupled between a data line and a first voltage line for transmitting a data signal;

a drive transistor having a control electrode is electrically coupled to the first switching element, being electrically coupled between the first voltage line and a second voltage line;

an organic light emitting diode electrically coupled to the drive transistor, displaying an image by a current supplied through the drive transistor;

a first capacitive element electrically coupled between the control electrode of the drive transistor and the first switching element;

a second capacitive element electrically coupled between the first capacitive element and the second voltage line;

a second switching element electrically coupled between the first voltage line and the control electrode of the drive transistor;

a third switching element electrically coupled between the first switching element and the drive transistor;

a fourth switching element electrically coupled between the control electrode of the drive transistor and the second voltage line;

a fifth switching element electrically coupled between the drive transistor and the second voltage line; and wherein a first electrode of the first switching element is electrically coupled to the data line, and a second electrode of the first switching element is electrically coupled between a first electrode of the third switching element and a second electrode of the first capacitive element and a first electrode of the second capacitive element.

2. The organic light emitting display of claim 1, wherein a control electrode of the second switching element is electrically coupled to a previous scan line, and a first electrode of the second switching element is electrically coupled between a first electrode of the fourth switching element and a first electrode of the first capacitive element and the control electrode of the drive transistor, and a second electrode of the second switching element is electrically coupled between the first voltage line and the first electrode of the drive transistor.

3. The organic light emitting display of claim 1, wherein a control electrode of the third switching element is electrically coupled to a threshold voltage compensation line, and a first electrode of the third switching element is electrically coupled between a second electrode of the first switching element and the second electrode of the first capacitive element and the first electrode of the second capacitive element, and a second electrode of the third switching element is electrically coupled between the drive transistor and the fifth switching element.

4. The organic light emitting display of claim 1, wherein a control electrode of the fourth switching element is electrically coupled to a negative annealing line, and a first electrode of the fourth switching element is electrically coupled between the control electrode of the drive transistor and the first electrode of the second switching element and the first electrode of the first capacitive element, and a second electrode of the fourth switching element is electrically coupled to the second voltage line.

5. The organic light emitting display of claim 1, wherein a control electrode of the fifth switching element is electrically coupled to an emission control line, and a first electrode of the fifth switching element is electrically coupled between the second electrode of the drive transistor and the second electrode of the third switching element, and a second electrode of the fifth switching element is electrically coupled to the second voltage line.

6. The organic light emitting display of claim 1, wherein an anode of the organic light emitting diode is electrically coupled to the fifth switching element, a cathode of the organic light emitting diode is electrically coupled to the second voltage.

7. The organic light emitting display of claim 1, wherein an anode of the organic light emitting diode is electrically coupled to the first voltage line, a cathode of the organic light emitting diode is electrically coupled between the first electrode of the drive transistor and the second electrode of the second switching element.

8. The organic light emitting display of claim 1, wherein a first electrode of the first capacitive element is electrically coupled between the first electrode of the second switching element and the control electrode of the drive transistor and the first electrode of the fourth switching element, and a second electrode of the first capacitive element is electrically coupled between the second electrode of the first switching element and the first electrode of the third switching element and the first electrode of the second capacitive element.

9. The organic light emitting display of claim 1, wherein a first electrode of the second capacitive element is electrically coupled between the second electrode of the first capacitive element and the second electrode of the first switching element and the first electrode of the third switching element, and a second electrode of the second capacitive element is electrically coupled between the second electrode of the fourth switching element and the second voltage line.

10. The organic light emitting display of claim 1, wherein the first, second, third, fourth and fifth switching elements and the drive transistor are an N type channel transistor.

11. The organic light emitting display of claim 1, wherein when the second and fifth switching elements are turned off and the first, third and fourth switching elements are turned on during an image display period of one frame, a data signal is applied to the second electrode of the drive transistor, and the second voltage is applied to the control electrode of the drive transistor.

12. An organic light emitting display, comprising:

a first switching element having a control electrode is electrically coupled to a scan line, being electrically coupled between a data line and a first voltage line for transmitting a data signal;

a drive transistor having a control electrode is electrically coupled to the first switching element, being electrically coupled between the first voltage line and a second voltage line;

an organic light emitting diode electrically coupled to the drive transistor, displaying an image by a current supplied through the drive transistor;

a first capacitive element electrically coupled between the control electrode of the drive transistor and the first switching element;

a second capacitive element electrically coupled between the first capacitive element and the first voltage line;

a second switching element electrically coupled between the second voltage line and the control electrode of the drive transistor;

a third switching element electrically coupled between the first switching element and the drive transistor;

a fourth switching element electrically coupled between the control electrode of the drive transistor and the first voltage line;

a fifth switching element electrically coupled between the drive transistor and the first voltage line; and wherein a first electrode of the first switching element is electrically coupled to the data line, and a second electrode of the first switching element is electrically coupled between a first electrode of the third switching element and a first electrode of the first capacitive element and a second electrode of the second capacitive element.

13. The organic light emitting display of claim 12, wherein a control electrode of the second switching element is electrically coupled to a previous scan line, and a first electrode of the second switching element is electrically coupled between a second electrode of the fourth switching element and a second electrode of the first capacitive element and the control electrode of the drive transistor, and a second electrode of the second switching element is electrically coupled between the second voltage line and the second electrode of the drive transistor.

14. The organic light emitting display of claim 12, wherein a control electrode of the third switching element is electrically coupled to a threshold voltage compensation line, and a first electrode of the third switching element is electrically coupled between a second electrode of the first switching element and the first electrode of the first capacitive element and the second electrode of the second capacitive element, and a second electrode of the third switching element is electrically coupled between the drive transistor and the fifth switching element.

15. The organic light emitting display of claim 12, wherein a control electrode of the fourth switching element is electrically coupled to a negative annealing line, and a first electrode of the fourth switching element is electrically coupled to the first voltage line, and a second electrode of the fourth switching element is electrically coupled between the control electrode of the drive transistor and the first electrode of the second switching element and the second electrode of the first capacitive element.

16. The organic light emitting display of claim 12, wherein a control electrode of the fifth switching element is electrically coupled to an emission control line, and a first electrode of the fifth switching element is electrically coupled to the first voltage line, and a second electrode of the fifth switching element is electrically coupled between the first electrode of the drive transistor and the second electrode of the third switching element.

17. The organic light emitting display of claim 12, wherein an anode of the organic light emitting diode is electrically coupled between the second electrode of the drive transistor and the second electrode of the second switching element, and a cathode of the organic light emitting diode is electrically coupled to the second voltage.

18. The organic light emitting display of claim 12, wherein an anode of the organic light emitting diode is electrically coupled to the first voltage line, a cathode of the organic light emitting diode is electrically coupled to the first electrode of the fifth switching element.

19. The organic light emitting display of claim 12, wherein a first electrode of the first capacitive element is electrically coupled between the second electrode of the first switching element and the first electrode of the third switching element and the second electrode of the second capacitive element, and a second electrode of the first capacitive element is electrically coupled between the first electrode of the second switching element and the control electrode of the drive transistor and the second electrode of the fourth switching element.

20. The organic light emitting display of claim 12, wherein a first electrode of the second capacitive element is electrically coupled between the first electrode of the fourth switching element and the first voltage line, and a second electrode of the second capacitive element is electrically coupled between the first electrode of the first capacitive element and the second electrode of the first switching element and the first electrode of the third switching element.

21. The organic light emitting display of claim 12, wherein the first, second, third, fourth and fifth switching elements and the drive transistor are a P type channel transistor.

22. The organic light emitting display of claim 12, wherein when the second and fifth switching elements are turned off and the first, third and fourth switching elements are turned on during an image display period of one frame, a data signal is applied to the first electrode of the drive transistor, and the first voltage is applied to the control electrode of the drive transistor.

* * * * *